US008169377B2

(12) United States Patent
Tippit et al.

(10) Patent No.: US 8,169,377 B2
(45) Date of Patent: May 1, 2012

(54) DUAL OPPOSED DRIVE LOOP ANTENNA POINTING APPARATUS AND METHOD OF OPERATION

(75) Inventors: Larry Jack Tippit, Arlington, TX (US); Daniel Alan Beall, Allen, TX (US); Julian Patrick Moore, Sachse, TX (US)

(73) Assignee: ASC Signal Corporation, Smithfield, NC (US)

( * ) Notice: Subject to any disclaimer, the term of this patent is extended or adjusted under 35 U.S.C. 154(b) by 334 days.

(21) Appl. No.: 12/418,757

(22) Filed: Apr. 6, 2009

(65) Prior Publication Data

US 2010/0253586 A1 Oct. 7, 2010

(51) Int. Cl.
*H01Q 1/12* (2006.01)
*H01Q 3/08* (2006.01)

(52) U.S. Cl. ..... 343/757; 343/766

(58) Field of Classification Search ..... 343/709, 343/757, 758, 763, 765, 766, 882; 342/359
See application file for complete search history.

(56) References Cited

U.S. PATENT DOCUMENTS

| | | | | |
|---|---|---|---|---|
| 2,419,210 | A * | 4/1947 | Hanna et al. | 318/648 |
| 2,740,962 | A | 1/1950 | Hammond, Jr. | |
| 3,372,603 | A | 3/1968 | Suliteanu et al. | |
| 3,789,414 | A | 1/1974 | Bauer et al. | |
| 4,442,435 | A | 4/1984 | Kiryu et al. | |
| 4,490,724 | A | 12/1984 | Bickman | |
| 4,491,388 | A | 1/1985 | Wood | |
| 4,920,350 | A | 4/1990 | McGuire et al. | |
| 5,025,262 | A | 6/1991 | Abdelrazik et al. | |
| 5,227,806 | A | 7/1993 | Eguchi | |
| 5,389,940 | A | 2/1995 | Sutherland | |
| 6,177,910 | B1 | 1/2001 | Sathoff et al. | |
| 6,195,060 | B1 | 2/2001 | Spano et al. | |
| 6,844,856 | B1 | 1/2005 | Wright | |
| 6,914,578 | B1 | 7/2005 | Menahem | |
| 7,129,901 | B2 | 10/2006 | Tietjen | |
| 2004/0000829 | A1 | 1/2004 | McVicar | |
| 2007/0052604 | A1 | 3/2007 | Young et al. | |

OTHER PUBLICATIONS

International Search Report / EPO, related application PCT/US2010/030017, application date Apr. 5, 2010 by the European Patent Office, P.B. 5818 Patentlaan 2, LN-2280 HV Rijswijk.

* cited by examiner

*Primary Examiner* — Michael C Wimer
(74) *Attorney, Agent, or Firm* — Babcock IP, PLLC

(57) ABSTRACT

A pointing apparatus and method of operation for an antenna mount provided with a base frame and an antenna mount rotatably coupled together. A first wheel rigidly coupled to one of the base frame and the antenna mount driven by a mechanical linkage with a first drive wheel and a second drive wheel mounted to the base frame or the antenna mount not rigidly coupled to the first wheel. The first drive wheel and the second drive wheel driven against one another in opposite directions; a torque level unbalance applied between the first motor and the second motor operative to rotate the base frame and the antenna mount with respect to one another in a first desired direction.

18 Claims, 9 Drawing Sheets

DUAL OPPOSED DRIVE LOOP ANTENNA POINTING APPARATUS AND METHOD OF OPERATION

BACKGROUND

For optimal performance, a directional antenna such as a reflector antenna requires close alignment with a target signal source. Alignment of a reflector antenna is typically performed via an adjustable antenna mount that, with respect to a fixed mounting point, is adjustable in azimuth and elevation to orient the antenna towards the target signal source.

Distance target signal sources, such as satellites, may require alignment precision on the order of 1/100 of a degree for maximum signal efficiency.

Typical mechanized antenna pointing arrangements apply a drive motor with a position feedback loop to energize the drive motor forward and backwards along a single axis. Alignment in multiple axes is adjusted until a desired directional alignment is reached. Mechanical linkages between the drive motor and antenna base may be via gears, belts, cables, chains or the like.

A significant problem with mechanical linkage precision, especially where a high level of pointing precision is required, is backlash/hysteresis accumulated from slack in the mechanical linkage, rotational bearings, gear teeth and or gear mounting keyways.

A prior antenna pointing solution addressing the backlash/hysteresis problem applies a high precision gear drive having a large bull gear directly driven by two pinion gear drive servo motors to precisely control antenna position. The two servo motors are controlled to maintain a minimum level of torque against each other with only one servo drive at a time delivering the extra power to overcome the other servo drive and rotate the antenna to position. Thereby, all of the backlash/hysteresis in the system is preloaded to one side. However, even if manufactured with a high level of precision, there is backlash/hysteresis in the gears themselves, the keyways holding the gears to the drive shafts, in the pinion gear reduction box, in each bearing in the drive train, and even in the shafts themselves. The precision manufacturing tolerances required in a drive system of this type significantly increases costs, especially where the drive system dimensions must be scaled to point an antenna of significant size and/or under variable wind load conditions. Further, gear driven antenna pointing systems of this type add significant weight to the overall antenna system, a significant factor for mobile satellite communications systems.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

Figure 1:
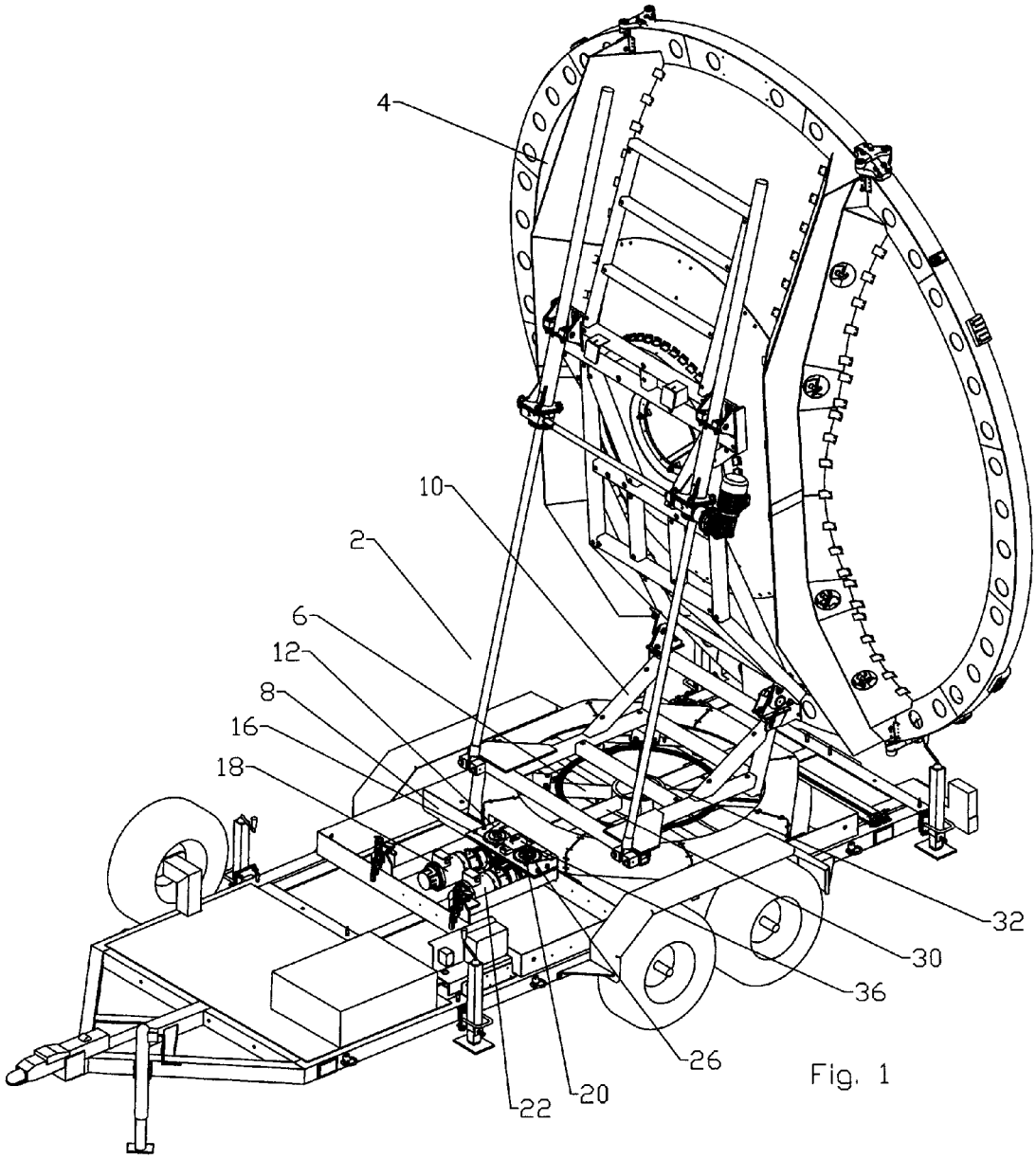
FIG. 1 is a schematic isometric view of a reflector antenna with a first exemplary embodiment of a pointing apparatus for azimuth orientation, an access cover removed to show the drive motor area.
Figure 2:
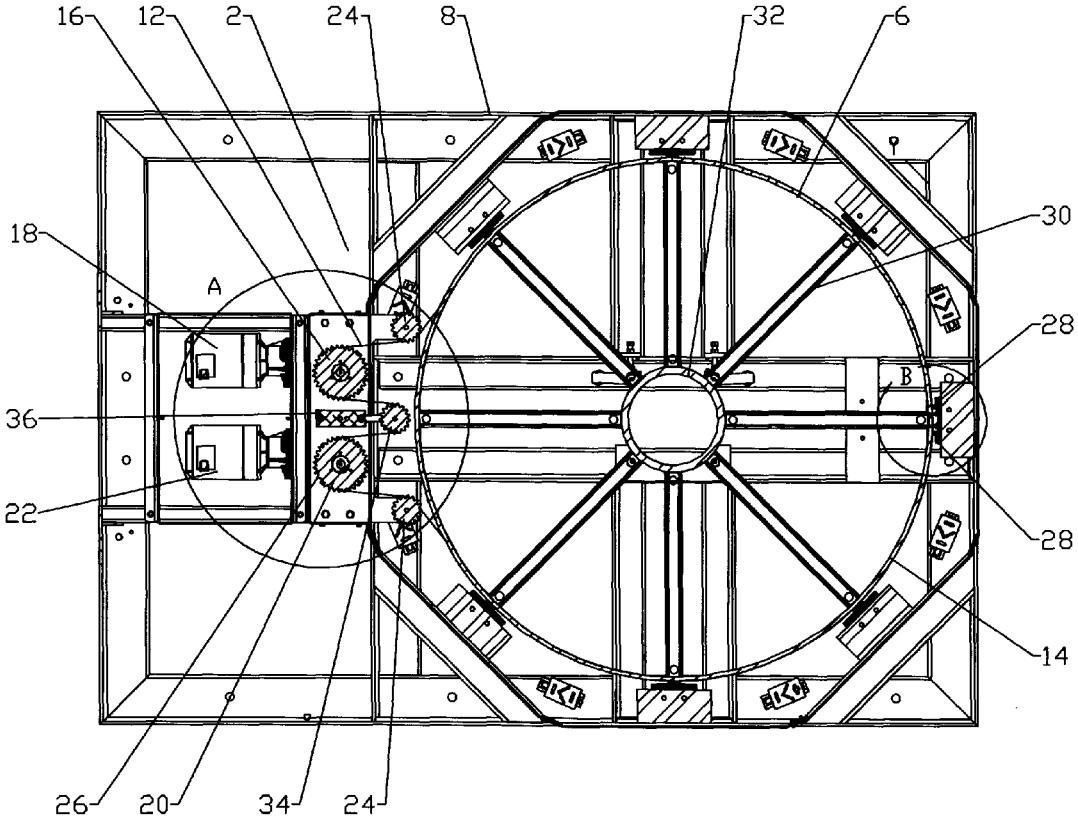
FIG. 2 is a schematic top view of the pointing apparatus of FIG. 1, antenna, antenna mounting and trailer structures removed for clarity.

An exemplary first embodiment of an antenna pointing system 2 according to the invention is shown for example in FIGS. 1-6, here demonstrating azimuth positioning on a mobile satellite communications reflector antenna 4. A first wheel 6 is rotatably mounted upon a base frame 8, best shown in FIG. 2, which further supports the antenna base 10 and reflector antenna 4 thereupon.

Thereby, when the base frame 8 is leveled, the reflector antenna 4 is rotatable in the azimuth plane as the first wheel 6 is rotated.

Figure 3:
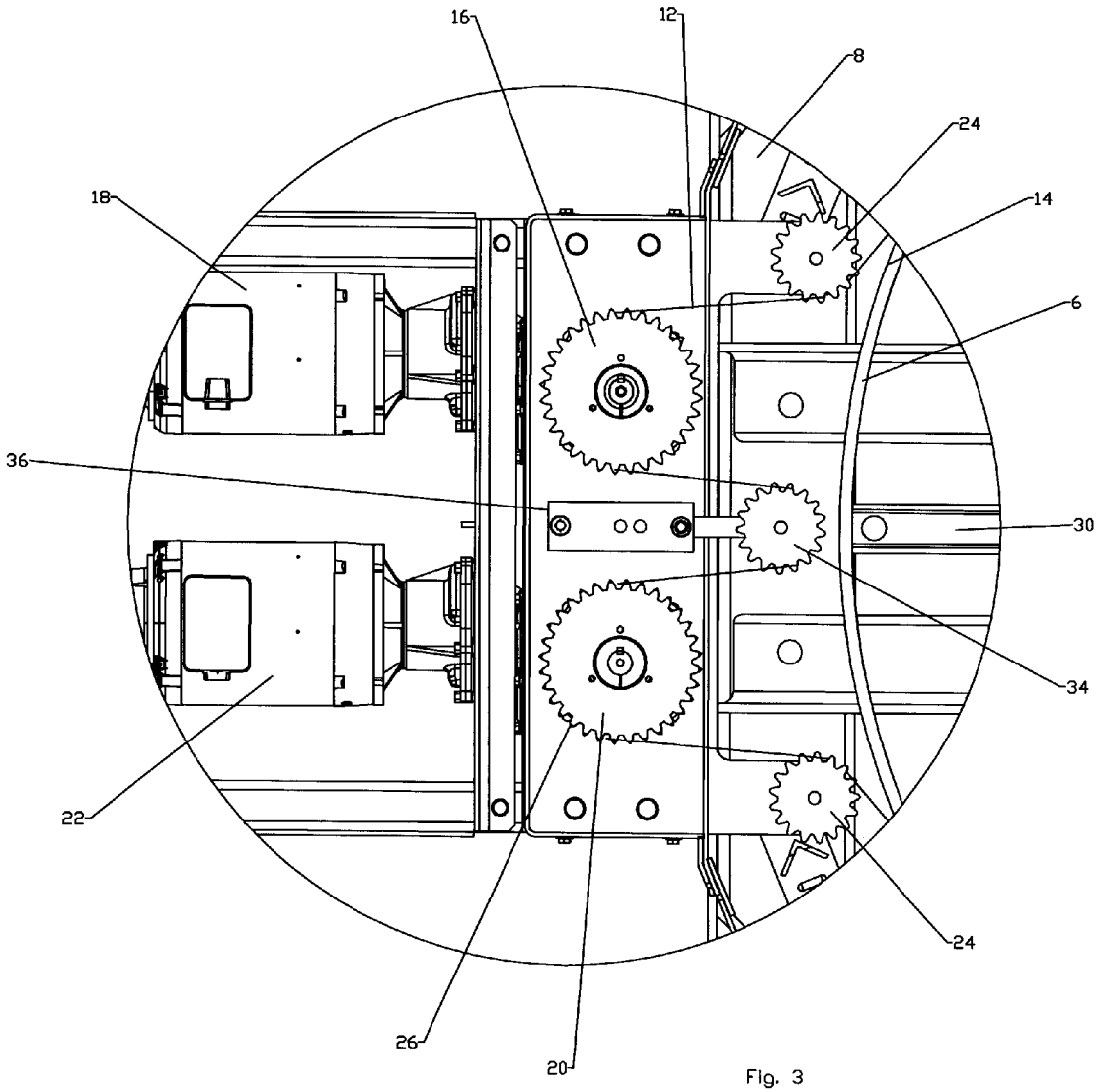
FIG. 3 is a close-up view of area A of FIG. 2.
Figure 4:
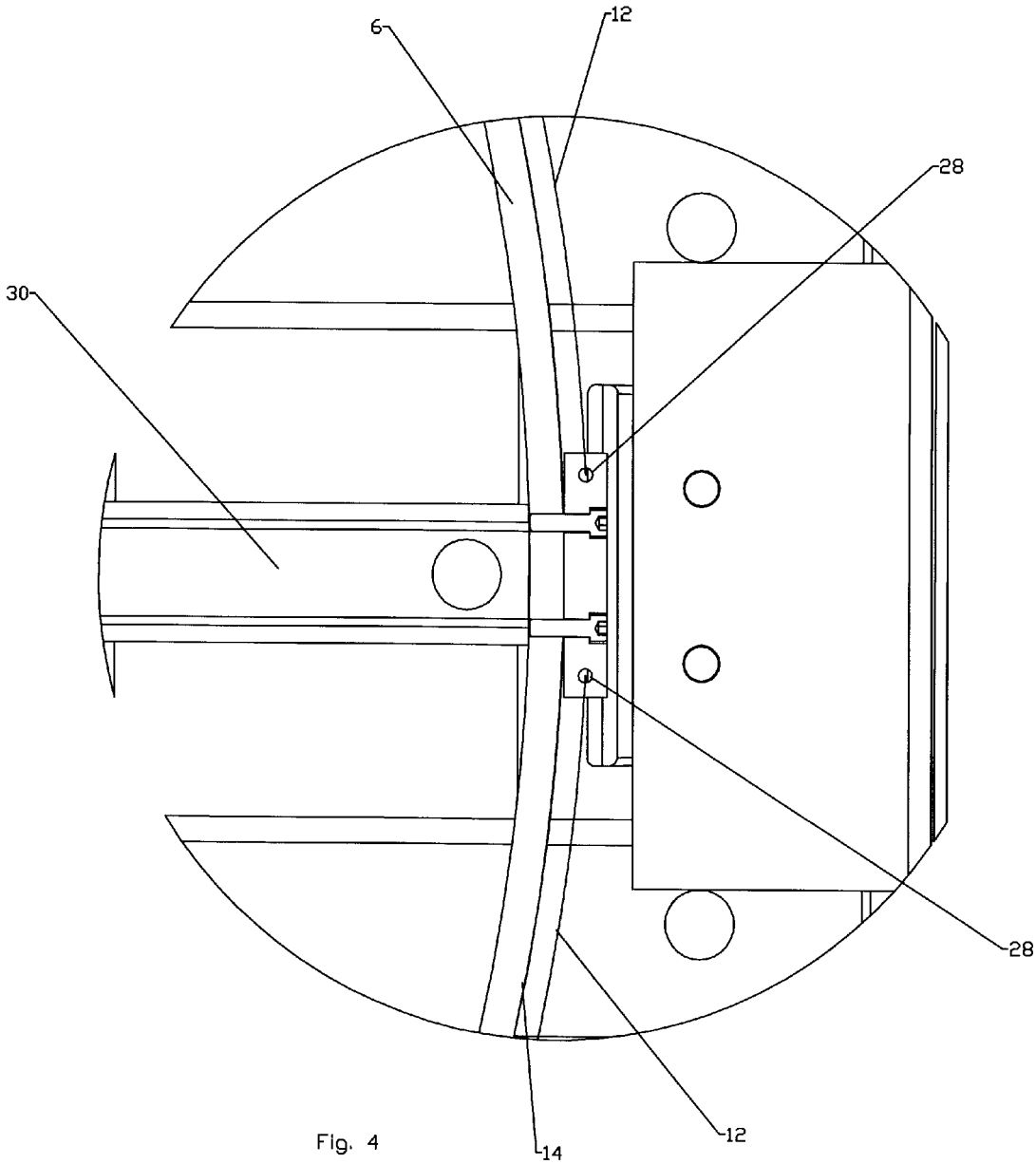
FIG. 4 is a close-up view of area B of FIG. 2.

As shown in FIGS. 3 and 4, a first mechanical linkage 12 passes around a rim 14 of the first wheel 6, a first drive wheel 16 coupled to the base frame 8, driven by a first motor 18 and a second drive wheel 20 coupled to the base frame, driven by a second motor 22. Pulley(s) 24 may be applied to route the first mechanical linkage 12 proximate the first wheel 6, without requiring the first and second drive wheels 16,20 to also be there against which may create a dimensional conflict, for example with gear heads of the first and second drive motors 18,22. The first mechanical linkage 12 rotationally interlocks the first wheel 6, the first drive wheel 16 and the second drive wheel 20. As a gear ratio between the first wheel 6 and the first and second drive wheels 16,22 is increased via the differential between the wheel diameters, angular resolution of the pointing system may be increased.

The first mechanical linkage 12 may be applied as any flexible member with sufficient longitudinal strength, such as a chain coupled to the first wheel 6 that positively engages teeth or other positive drive surface(s) 26 on the first drive wheel 16 and the second drive wheel 20. Alternatively, the first mechanical linkage 12 may be provided in other forms such as a belt or cable, configured to also provide a rotational interlock.

Where the first mechanical linkage 12 is a chain, end links of the chain may be each coupled to a termination point 28 located on the periphery of the first wheel 6, for example as shown in FIG. 4, eliminating the need to provide a positive drive surface 26 around the circumference of the entire first wheel 6. Thus, a rotation range of the arrangement is between a tangent line on each side of the first wheel between the respective first and second drive wheels 16,20 or any interceding pulley(s) 24 that may be present. If a smaller rotation range is acceptable/desired and/or to minimize system weight, separate termination point(s) 28 may be applied, one for each side separated by a distance along the first wheel 6 periphery that provides the desired rotation range. Alternatively, the first mechanical linkage 12 may be a contiguous loop, for example to obtain maximum range of rotation.

Figure 5:
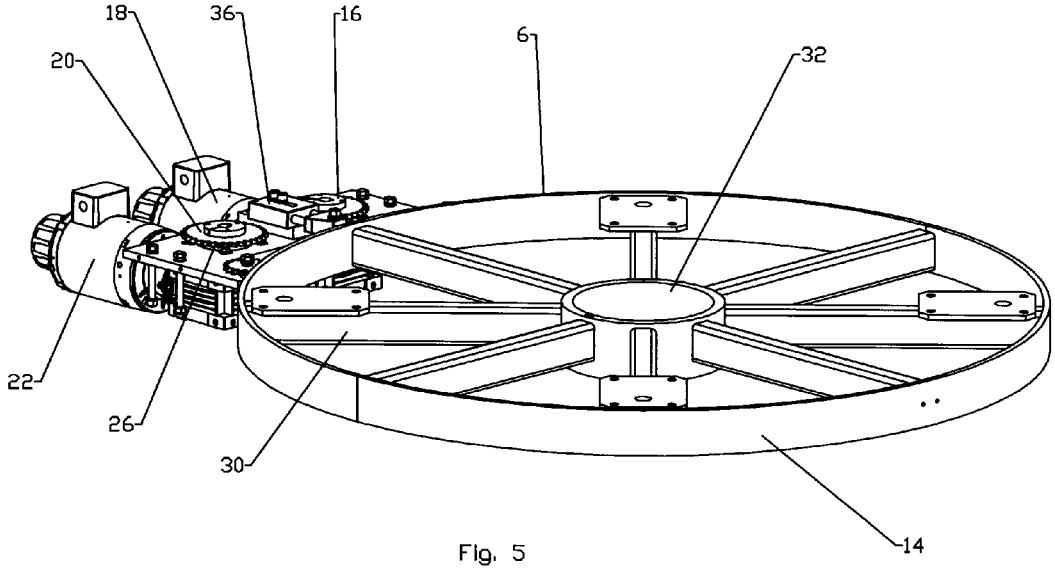
FIG. 5 is a schematic isometric angled view of an exemplary first wheel, drive motors and wheels.
Figure 6:
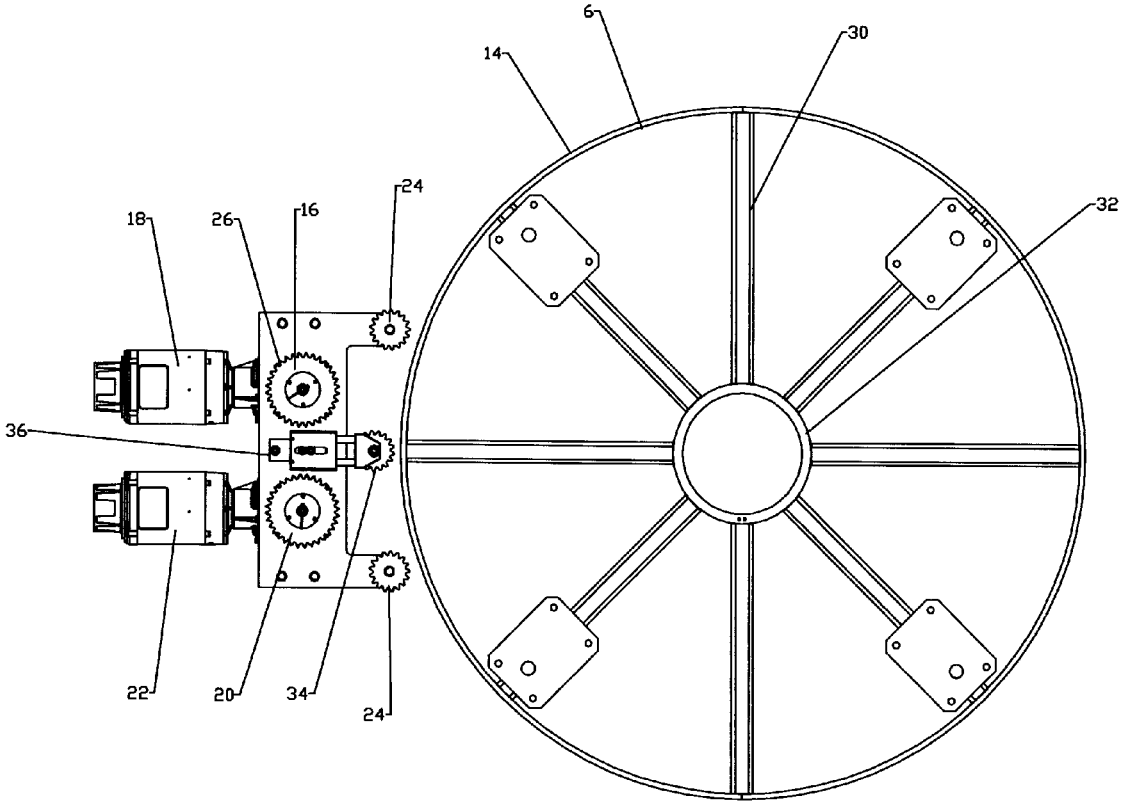
FIG. 6 is a schematic top view of FIG. 5.

As best shown in FIGS. 5 and 6, the first wheel 6 is demonstrated as a "wagon" wheel with spokes 30 extending to the rim 14 from a hub 32. The number and size of the spoke(s) 30 may be selected to provide a balance of weight and strength. Alternatively, the first wheel 6 may have other configurations, such as a solid disc or the like.

To simplify assembly and/or maintenance of the first mechanical linkage 12, one or more tension wheel(s) 34 coupled to the base frame 8 may be applied. For example located between the first drive wheel 16 and the second drive wheel 20, the tension wheel 34 is positioned in-line with the first mechanical linkage 12, for example adjustable via a tension mechanism 36 to shorten or extend the path of the first mechanical linkage 12, to tighten the first mechanical linkage 12 to a desired level. The presence of the tension wheel 34 between the first drive wheel 16 and the second drive wheel 20 also improves the strength and reliability of the antenna pointing system 2, by increasing the engagement area between the first mechanical linkage 12 and the first and second drive wheels 16,20, enabling application of smaller first and second drive wheels 16,20, again increasing the gear ratio between the first and second drive wheels 16,20 and the first wheel 6.

The first motor and the second motor 16,20 are driven in reverse directions to each other, creating a tension in the first mechanical linkage 12 that takes up any backlash/hysteresis that may be present in the drive system. To rotate the reflector antenna 4 in one direction or another, one or the other of the torque levels supplied to the first motor 18 and the second motor 22 is increased to a point where it overcomes the reverse direction torque of the opposing motor. The torque differential may also be adjusted to determine the speed, acceleration and/or deceleration of rotation. Thereby, precision rotation control with significant reduction of backlash/hysteresis may be obtained.

To maintain a fixed positioning, the first and second motors 18,22 may be provided with an equal torque level, each motive force canceling out the other. As variable forces such as wind loads add to a torque level in one direction or another, the motor control circuits can dynamically adjust the "stasis" torque differential required to maintain a desired positioning. Control circuits for the first motor 18 and the second motor 22 monitor may be configured to monitor motor parameters such as current level and/or temperature.

Figure 7:
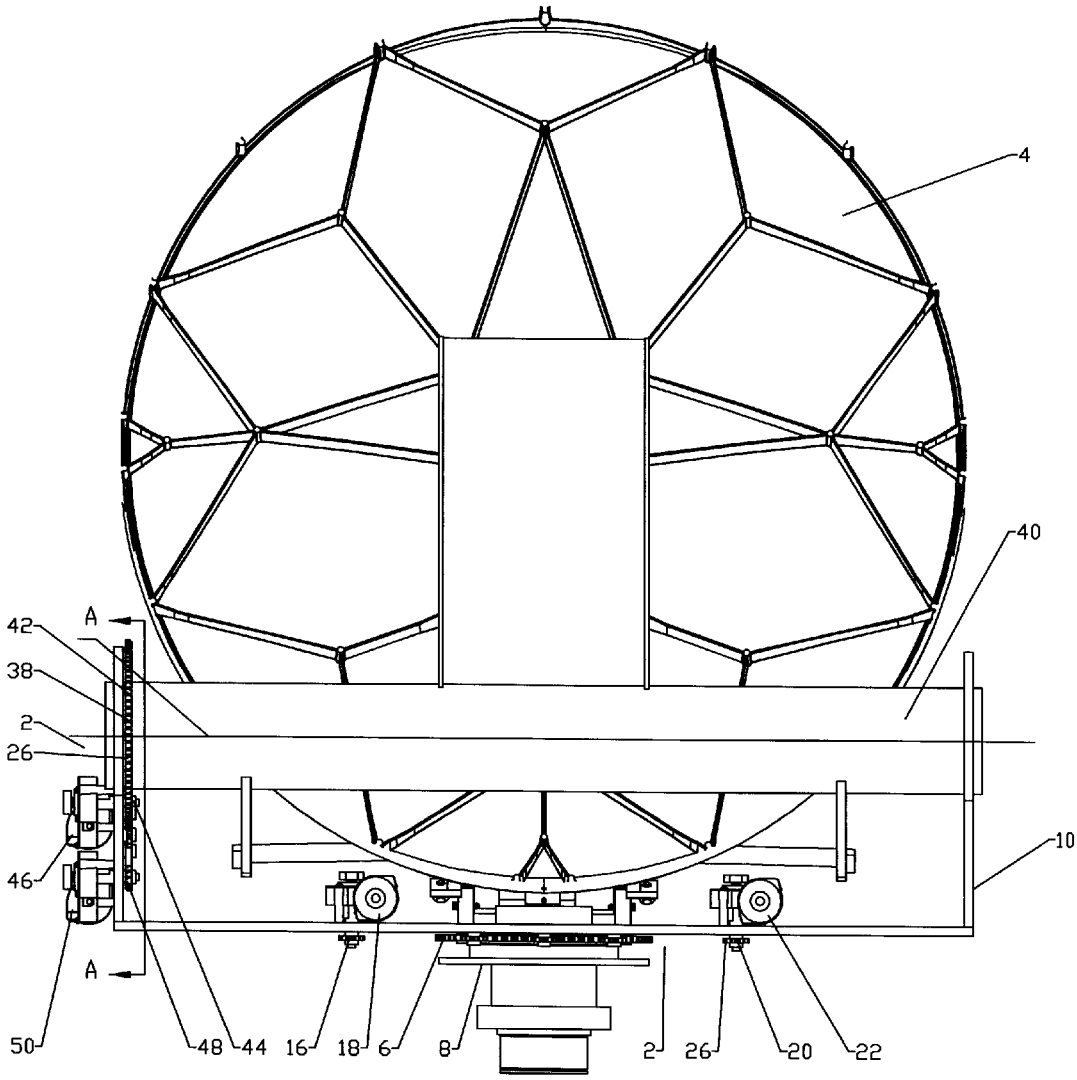
FIG. 7 is a schematic isometric back view of a reflector antenna with a second exemplary embodiment of a pointing apparatus for azimuth and elevation orientation.
Figure 8:
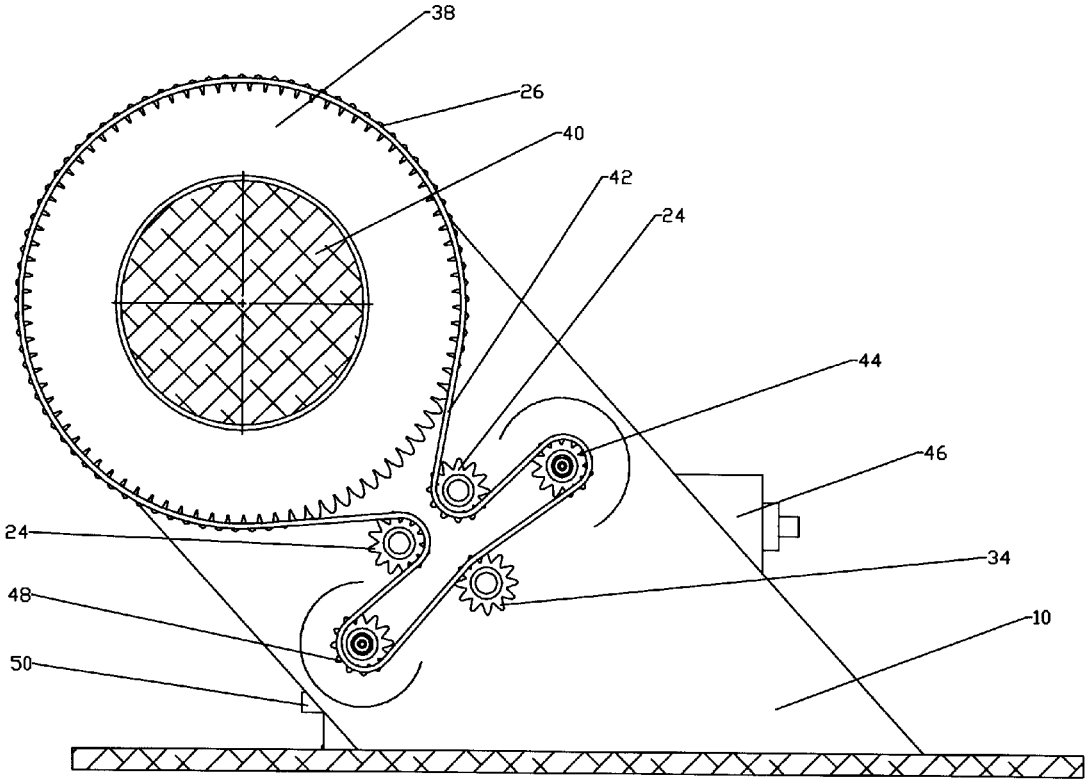
FIG. 8 is a schematic close-up view along line A-A of FIG. 7.
Figure 9:
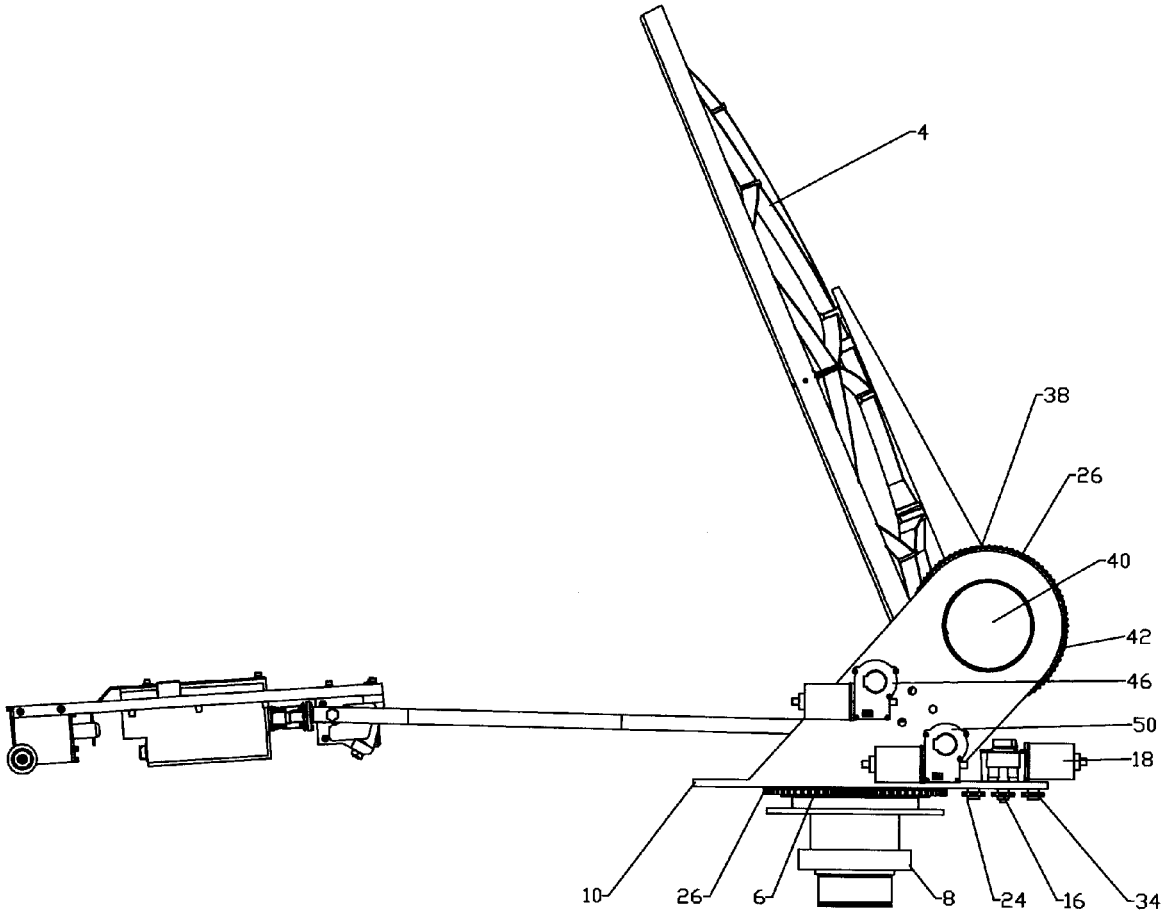
FIG. 9 is a side view of FIG. 7.

In alternative embodiment(s) the antenna pointing system 2 may also be aligned in a second axis of rotation, for example as shown in FIGS. 7-9 to provide elevation pointing capability. Further, multiple antenna pointing system(s) 2 may be applied in cooperation to provide the reflector antenna 4 with both azimuth and elevation control. A second wheel 38 is coupled, for example, to an elevation shaft 40 to which the reflector antenna 4 is itself coupled. The second wheel 38 and elevation shaft 40 rotatably mounted on the antenna base 10, preferably oriented normal to the first wheel 6. Rotation of the elevation shaft 40 via the second wheel 38 is operative to rotate the reflector antenna 4 in the elevation plane. Similar to the first wheel 6 arrangement, a second mechanical linkage 42 links a third drive wheel 44 driven by a third drive motor 46 and a fourth drive wheel 48 driven by a fourth drive motor 50. Pulley(s) 24 and a tension wheel 34 may also be provided along the second mechanical linkage 42, here demonstrated as a continuous loop engaging a positive drive surface of the second wheel 38 (FIG. 8). The third drive motor 26 and the fourth drive motor 50 are similarly configured and controlled to oppose one another with respect to minimal backlash/hysteresis rotation about the second wheel 38 and elevation shaft 40, according to the description provided for the azimuth plane antenna pointing system 2, herein above, to rotate the elevation shaft 40 and thus the reflector antenna 4 through the elevation plane.

Also as demonstrated in the present embodiment, the mounting positions of the various elements of the antenna pointing system 2 may be exchanged with respect to which of the elements are fixed in place with respect to the base frame 8 and the antenna mount 10. For example as best shown in FIG. 9, the first wheel 6 may be rigidly coupled to the base frame 8 and the antenna base 10 rotatably coupled to the base frame, independent of the first wheel 6. The corresponding first drive wheel 16, first motor 18, second drive wheel 20, second drive surface 26 motor 22, pulley(s) 24 (if any) and tension wheel 34 (if any) are mounted on the antenna base 10. Thereby, the first mechanical linkage 12 (removed from FIGS. 8 and 9 for clarity) drives the antenna base 10 about the base frame 8 and first wheel 6 according to the relative torque levels of the first and second motors 18,22.

The mounting of the second wheel 38 and associated drive wheels/motors described herein above is also a functional equivalent to an arrangement wherein the second wheel 38 rigid mounting is exchanged between the antenna mount 10 and the elevation shaft 40 and the drive wheels/motors are exchanged between the elevation shaft 40 and the antenna mount 10.

One skilled in the art will appreciate that the present invention provides an alternative to prior precision bull and pinion gear antenna pointing arrangements, significantly reducing the cost and weight of the resulting antenna pointing system 2, without sacrificing precision. Also, the time required for installation and configuration of a reflector antenna 4 incorporating an antenna positioning arrangement according to the invention is similarly reduced, as is the need for regular cost intensive maintenance procedures and parts replacements associated with the prior precision gear driven configurations.

Table of Parts

| | |
|---|---|
| 2 | antenna pointing system |
| 4 | reflector antenna |
| 6 | first wheel |
| 8 | base frame |
| 10 | antenna base |
| 12 | first mechanical linkage |
| 14 | rim |
| 16 | first drive wheel |
| 18 | first motor |
| 20 | second drive wheel |
| 22 | second motor |
| 24 | pulley |
| 26 | positive drive surface |
| 28 | termination point |
| 30 | spoke |
| 32 | hub |
| 34 | tension wheel |
| 36 | tension mechanism |
| 38 | second wheel |
| 40 | elevation shaft |
| 42 | second mechanical linkage |
| 44 | third drive wheel |
| 46 | third drive motor |
| 48 | fourth drive wheel |
| 50 | fourth drive motor |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A pointing apparatus for an antenna mount, comprising:

a base frame and an antenna mount rotatably coupled together;

a first wheel rigidly coupled to one of the base frame and the antenna mount;

a first drive wheel, driven by a first motor and a second drive wheel driven by a second motor; the first drive wheel and the second drive wheel rigidly coupled to the one of the base frame and the antenna mount not coupled to the first wheel;

a flexible first mechanical linkage rotationally interlocking the first wheel, the first drive wheel and the second drive wheel;

the first motor and the second motor driven against one another in opposite directions; a torque level unbalance applied between the first motor and the second motor operative to rotate the base frame and the antenna mount with respect to one another in a first desired direction via the first mechanical linkage.

2. The pointing apparatus of claim 1, further including a tension wheel coupled to the one of the base frame and the antenna mount, the first drive wheel and the second drive wheel are rigidly coupled to; the tension wheel in-line with the first mechanical linkage, adjustable to shorten or extend a mechanical linkage path, to tension the first mechanical linkage to a desired level.

3. The pointing apparatus of claim 2, wherein the tension wheel is between the first motor and the second motor, along the mechanical linkage path.

4. The pointing apparatus of claim 1, wherein ends of the first mechanical linkage are each coupled to a connection point on the rim of the first wheel.

5. The pointing apparatus of claim 1, wherein the first mechanical linkage is a chain.

6. The pointing apparatus of claim 1, further including at least one pulley engaging the first mechanical linkage.

7. The pointing apparatus of claim 1, further including a second wheel rotatably mounted upon the antenna mount; an elevation shaft coupled to the second wheel and a reflector antenna coupled to the elevation shaft; a third drive wheel coupled to the antenna mount, driven by a third motor; a fourth drive wheel coupled to the antenna mount, driven by a forth motor; a second flexible mechanical linkage loop rotationally interlocking the second wheel, third drive wheel and the fourth drive wheel; the third motor and the fourth motor driven against each other in opposite directions; a torque level unbalance applied between the third motor and the fourth motor operative to drive the second wheel in a second desired direction via the second mechanical linkage.

8. The antenna mount of claim 7, wherein rotation with respect to the first wheel adjusts an antenna azimuth direction and rotation with respect to the second wheel adjusts an antenna elevation direction.

9. A method for pointing an antenna, comprising the steps of: applying a torque level differential between a first motor and a second motor driven against one another other in opposite directions; a first wheel rigidly coupled to one of a base frame and an antenna mount; the first motor driving a first drive wheel, and the second motor driving a second drive wheel; the first drive wheel and the second drive wheel rigidly coupled to the one of the base frame and the antenna mount that the first wheel is not coupled to; the base frame and the antenna mount rotatably coupled together; a flexible first mechanical linkage rotationally interlocking the first wheel, the first drive wheel and the second drive wheel; the torque level differential rotating the antenna in the direction of the first motor or the second motor depending upon which of the first and the second motors is provided with a higher torque level.

10. The method of claim 9, wherein application of an equal torque level to the first motor and the second motor maintains the antenna at a desired orientation.

11. The method of claim 9, further including motor control circuits which dynamically adjust a stasis torque differential required to maintain a desired antenna orientation.

12. A pointing apparatus for an antenna mount, comprising: a first wheel mounted upon a base frame; the antenna mount rotatably coupled to the base frame; a first drive wheel coupled to the antenna mount, driven by a first motor; a second drive wheel coupled to the antenna mount, driven by a second motor; a flexible first mechanical linkage rotationally interlocking the first wheel, the first drive wheel and the second drive wheel; the first motor and the second motor driven against each other in opposite directions; a torque level unbalance applied between the first motor and the second motor operative to rotate the antenna mount in a first desired direction via the first mechanical linkage.

13. The pointing apparatus of claim 12, further including a second wheel rotatably mounted upon the antenna mount; an elevation shaft coupled to the second wheel and a reflector antenna coupled to the elevation shaft; a third drive wheel coupled to the antenna mount, driven by a third motor; a fourth drive wheel coupled to the antenna mount, driven by a forth motor; a second flexible mechanical linkage loop rotationally interlocking the second wheel, third drive wheel and the fourth drive wheel; the third motor and the fourth motor driven against each other in opposite directions; a torque level unbalance applied between the third motor and the fourth motor operative to drive the second wheel in a second desired direction via the second mechanical linkage.

14. The antenna mount of claim 13, wherein rotation with respect to the first wheel adjusts an antenna azimuth direction and rotation with respect to the second wheel adjusts an antenna elevation direction.

15. The pointing apparatus of claim 12, further including a tension wheel coupled to the one of the base frame and the antenna mount the first drive wheel and the second drive wheel are rigidly coupled to; the tension wheel in-line with the first mechanical linkage, adjustable to shorten or extend a mechanical linkage path, to tension the first mechanical linkage to a desired level.

16. The pointing apparatus of claim 15, wherein the tension wheel is between the first motor and the second motor, along the mechanical linkage path.

17. The pointing apparatus of claim 12, wherein ends of the first mechanical linkage are each coupled to a connection point on the rim of the first wheel.

18. The pointing apparatus of claim 12, wherein the first mechanical linkage is a chain.

* * * * *